US005488890A

United States Patent [19]

Biasini

[11] Patent Number: 5,488,890

[45] Date of Patent: Feb. 6, 1996

[54] STRING INSTRUMENT HOLDER

[75] Inventor: Americole R. Biasini, Bellingham, Wash.

[73] Assignee: Manhasset Specialty Co., Yakima, Wash.

[21] Appl. No.: 202,436

[22] Filed: Feb. 28, 1994

[51] Int. Cl.[6] ..... G10D 1/02; G10D 3/00; A47F 5/00; A47H 1/10

[52] U.S. Cl. ..... 84/280; 84/327; 248/301; 248/231.81

[58] Field of Search ..... 84/327, 280, 329, 84/453; 248/229, 301, 312, 304, 303, 231.8

[56] References Cited

U.S. PATENT DOCUMENTS

| | | | |
|---|---|---|---|
| 487,165 | 11/1892 | Straley | 84/453 |
| 1,170,684 | 2/1916 | Schlieckert | 84/327 |
| 3,765,633 | 10/1973 | Caudill | 84/327 |

FOREIGN PATENT DOCUMENTS

| | | |
|---|---|---|
| 307571 | 11/1917 | Germany . |
| 484614 | 10/1929 | Germany . |
| 507169 | 9/1930 | Germany . |
| 7500 | of 1909 | United Kingdom . |

OTHER PUBLICATIONS

Holders for Trombone and Trumpet Mutes, products which were manufactured and sold by RICOH International, P.O. Box 661, Sun Valley, CA 91353–0661.

*Primary Examiner*—Cassandra C. Spyrou
*Attorney, Agent, or Firm*—Stratton Ballew

[57] ABSTRACT

This invention comprises an apparatus for the safe temporary storage of a string instrument and a bow. The string instrument holder is attached to the desk of a music stand by means of an attachment clamp which can be adjusted to accommodate varying thicknesses of music stand desks. The string instrument is then hung by its scroll from two curved support members, The bow for a string instrument is hung by its flog from an additional curved support section extending from one of the curved support members holding the string instrument.

6 Claims, 8 Drawing Sheets

STRING INSTRUMENT HOLDER

TECHNICAL FIELD

This invention relates to an apparatus for the safe temporary storage of a string instrument and a bow. More particularly, this invention relates to an apparatus for safely temporarily holding a violin or viola, and a bow, while at the same time making the instrument and bow easily accessible to the musician.

BACKGROUND OF THE INVENTION

The string instrument holder (hereafter "violin holder") of the present invention addresses several needs unique to string instrument musicians. A stringed instrument of any kind is extremely delicate, and must be handled with care. Violins and violas are the smallest members of the stringed instrument family, and require extra care in handling. One part of a string instrument which must be especially protected is the bridge. The bridge is a very delicate wood piece which holds the strings away from the body of the instrument. A bridge is particularly susceptible to damage or movement due to its prominent exposed position. Movement of the bridge of a string instrument can adversely affect the integrity of the preperformance tuning of the instrument.

String instrument players have many occasions to temporarily hold or store their instruments during musical performances or practice sessions. Many pieces of music include periods of time when string instruments are not played, and must be held. Also, string instruments and bows must be temporarily stored during intermissions between musical pieces. Finally, string instrument musicians need to temporarily store their instruments at their practice facilities between practice sessions.

During these times, and especially during the performance of a piece of music and intermissions during musical performances, a musician needs to safely hold or store his or her string instrument within easy reach. When the time approaches to begin playing again, musician must be able to reach their instruments quickly, quietly, and with a minimum of disruption or extra movement.

Existing violin holders are designed to either stand alone, or to attach to the upright support leg of a music stand. There are several drawbacks to these existing designs.

A free-standing violin holder occupies floor space in an area which is often already crowded with music stands, chairs, instruments, and the musicians themselves. In addition, because musicians must place their music stands or music desks directly in front of them, a separate free-standing instrument stand must be located away from the music stand or music desk, making it more awkward for the musician to reach the instrument at the appropriate time. In addition, free-standing violin stands can easily be tipped over, resulting in damage to the instrument or bow. Another drawback of the free-standing violin stand is their size and portability. Because a free-standing instrument stand must include a base and structural support features to hold the instrument, a stand of this type is relatively cumbersome, even when it is collapsed.

Another existing design for a violin holder is one which attaches to the vertical support member of a music stand or music desk. However, the existing designs for such violin holders require that the string instrument be placed with its face (i.e., strings and bridge) facing away from the music stand. This leaves the bridge and strings exposed to people's feet and knees, chairs, and other instruments being carried by, and increases the likelihood of damage to the instrument.

It would be desirable, therefore, to have a violin holder which would attach to a music stand, and allow the instrument to be hung with its delicate face oriented away from the musician, and toward the support leg of the music stand.

The present invention provides a violin holder which may be attached to a music stand desk, and allows the instrument to be hung facing toward the vertical support member of the music stand. The location of the holder on the shelf of the music desk allows the string instrument to be hung easily and securely. The instrument cannot be bumped or knocked out of the holder, unless the entire music desk is tipped over. This is highly unlikely if a broad-based music desk is used.

Additionally, the present invention is designed to attach quickly, easily and removably, onto the shelf of a music desk, regardless of the thickness of the shelf. In addition, this invention is small enough to fit in the musician's pocket or instrument case. The present invention also provides a means for hanging the string instrument's bow.

DETAILED DESCRIPTION OF DRAWINGS

Figure 1A:
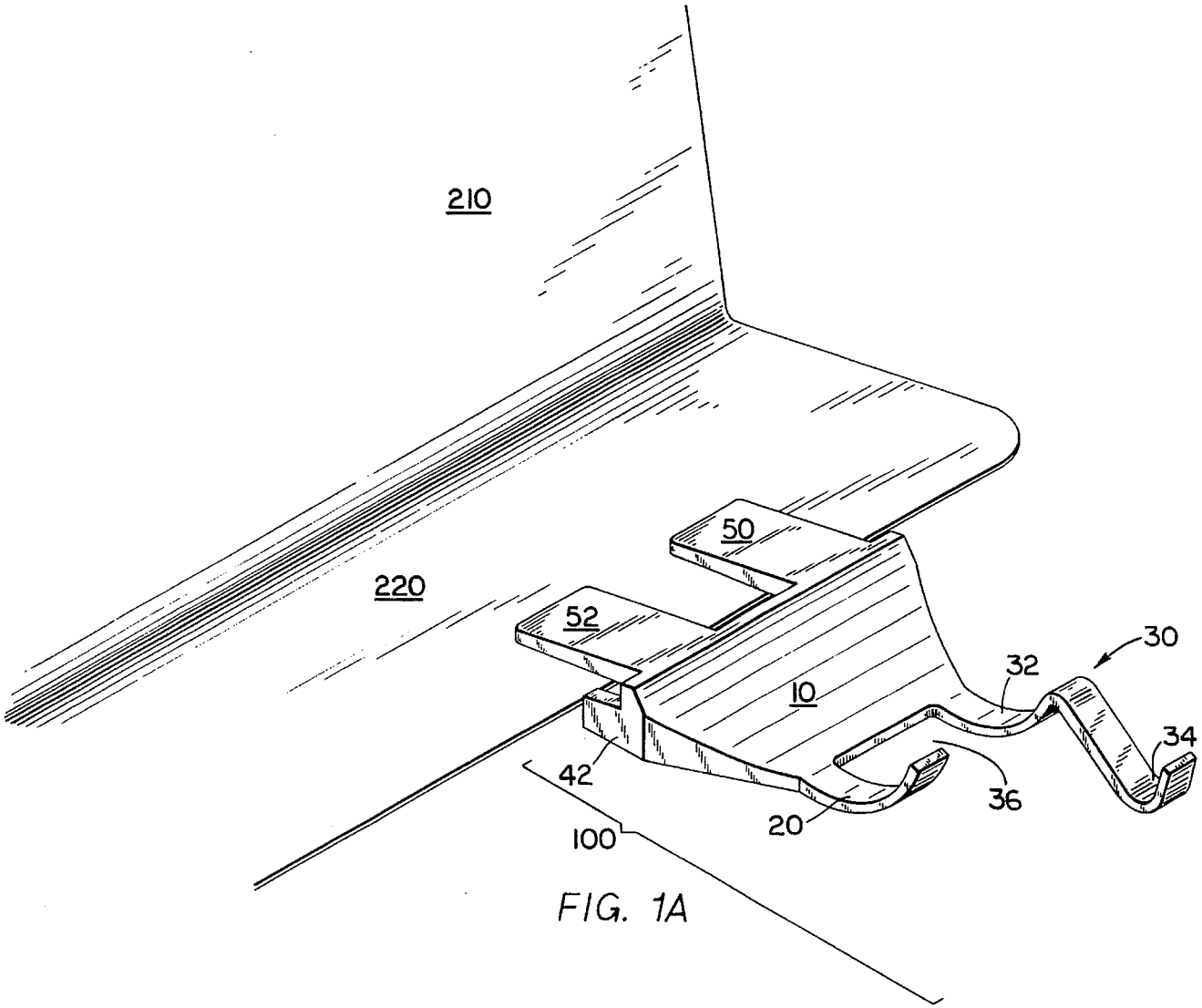
FIG. 1A A perspective view of the violin holder attached to a music stand desk.
Figure 1B:
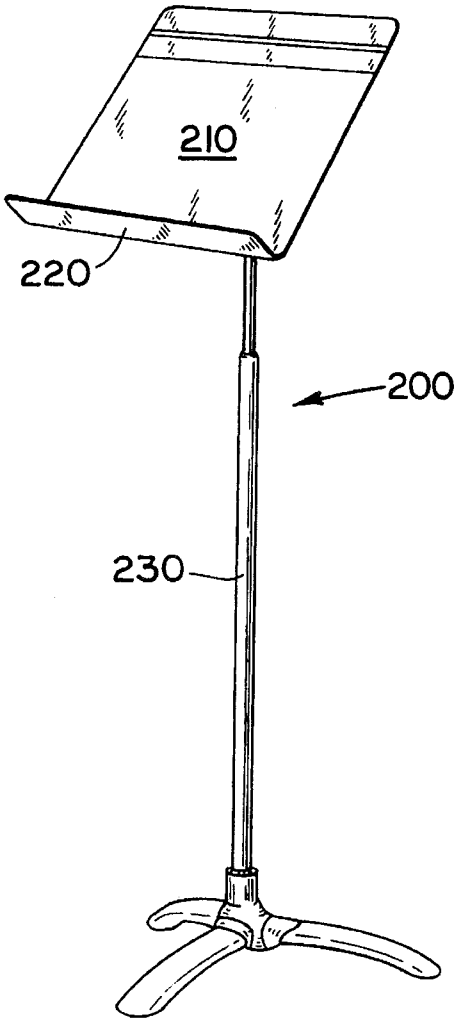
FIG. 1B A perspective view of a music stand.
Figure 3:
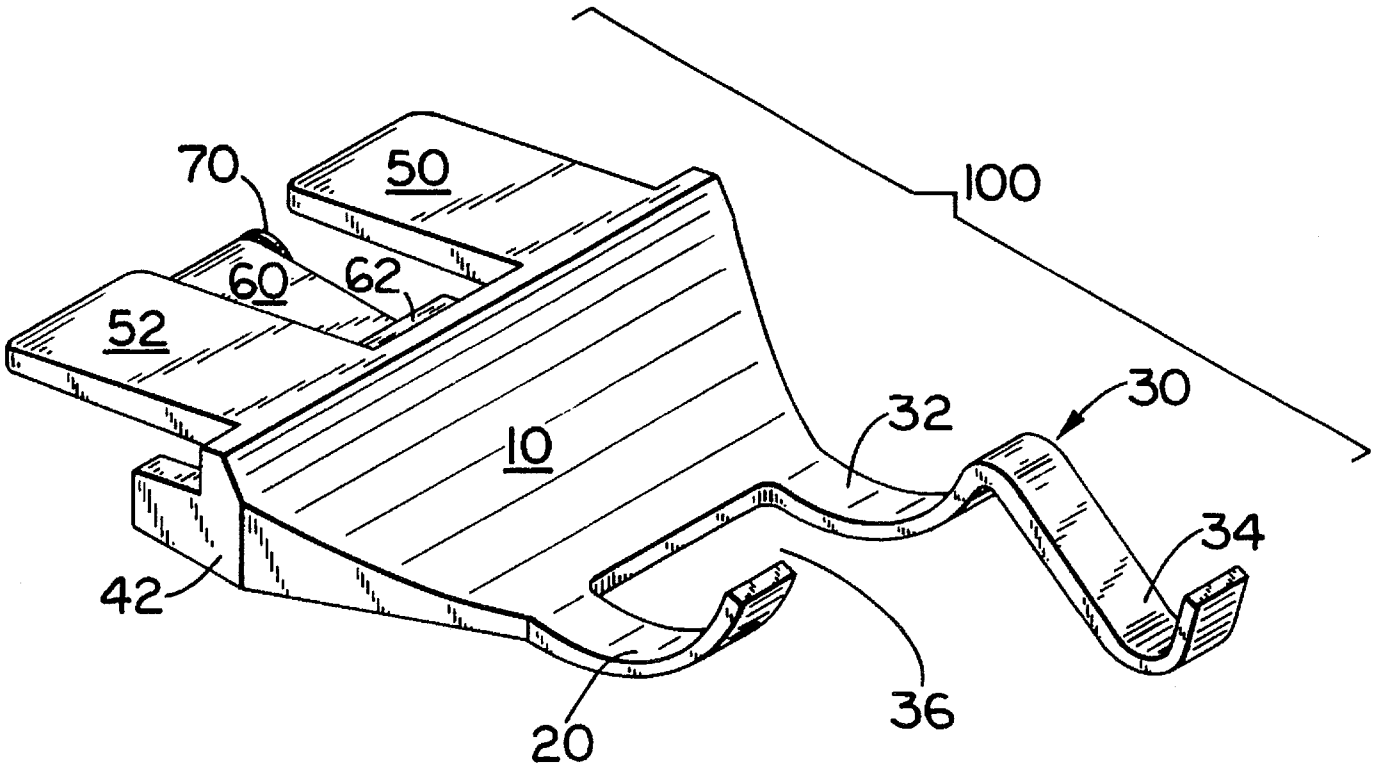
FIG. 3 A perspective view of the violin holder.

FIG. 1A shows the violin holder 100 attached to the shelf 220 of music stand desk 210 of music stand 200. The violin holder 100 is removably attached to music stand desk shelf 220 by means of top clamps 52, 50, and bottom clamp 60 (See FIG. 3). FIG 1B is a perspective drawing of a music stand, showing the relative position of the music stand desk 210, with Me music stand desk shelf 220, and the music stand vertical support member 230. Music stand 200 as shown in FIG. 1B is intended to be illustrative of music stands in general.

Figure 2:
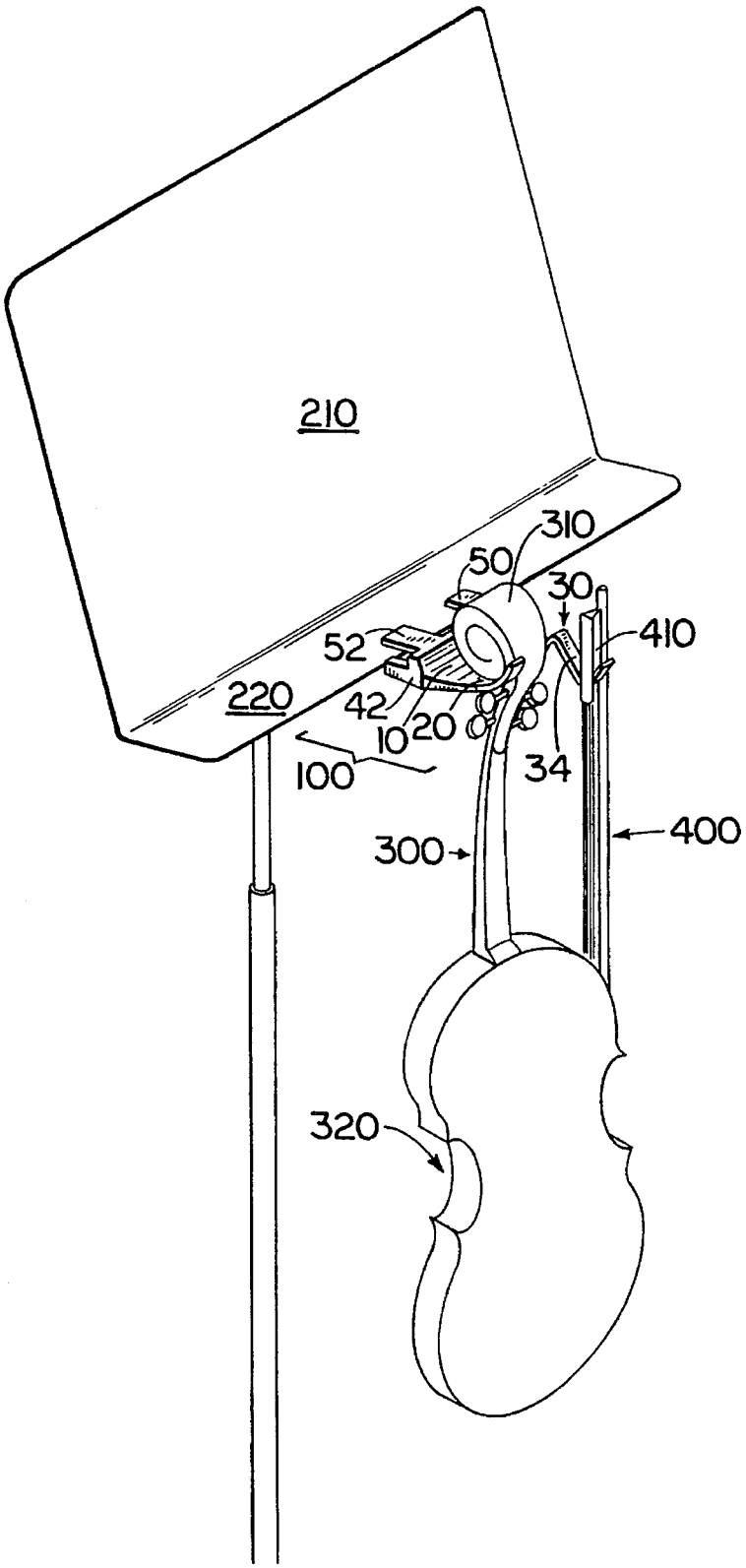
FIG. 2 A perspective view of the violin holder attached to a music stand desk with a violin and bow.
Figure 5:
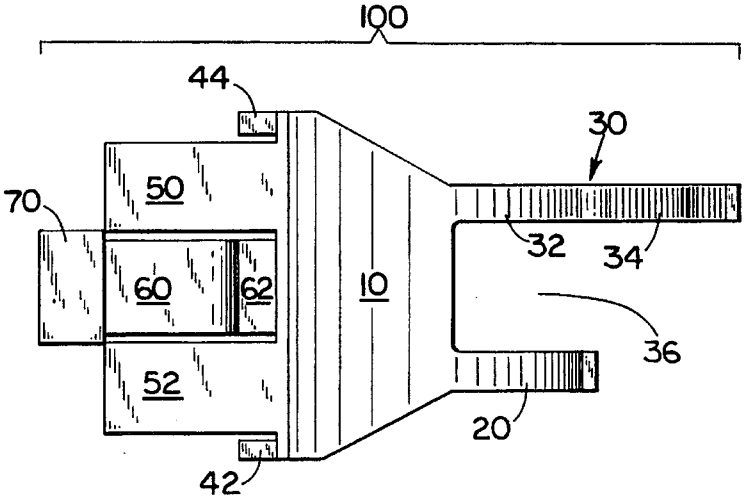
FIG. 5 Top view of the violin holder, with insertion clamp 70 engaged.

The violin holder 100 is attached to music desk shelf 220 by forcing the edge of shelf 220 between the contact point of top clamps 50 and 52 and insertion clamp 70 and then advancing the violin holder 100 onto shelf 220 until the edge of shelf 220 comes into contact with the point of abutment between insertion clamp 70 and top clamps 50 and 52. (See FIGS. 3 and 5.) The user then exerts upward pressure underneath top clamp 50 until a sufficient distance has been created between top clamp 50 and insertion clamp 70 to permit the edge of music desk shelf 220 to slide through. The violin holder 100 is then pushed forward onto music desk shelf 220 until projections 42, 62 and 44 come into contact with the edge of music desk shelf 220 and prevent any further forward progress of the violin holder 100. (See FIGS. 1A, 2 and 3.) At this point, the top surface of insertion clamp 70 is in direct contact with the bottom surface of music desk shelf 220. The bottom surfaces of clamp 52 and 50 are in direct contact with the top of music desk shelf 220. Once attached to the music stand desk in this manner, violin holder 100 can then be slidably moved along the edge of music desk shelf 220 to the user's desired position.

Figure 4:
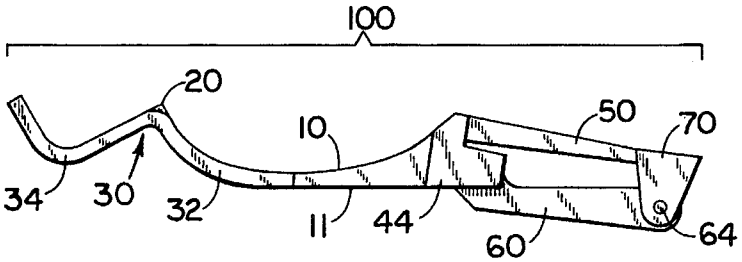
FIG. 4 Left side view of the violin holder, with insertion clamp 70 engaged.
Figure 6:
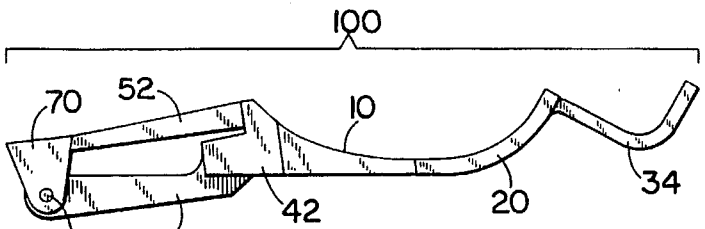
FIG. 6 Right side view of the violin holder, with insertion clamp 70 engaged.
Figure 10:
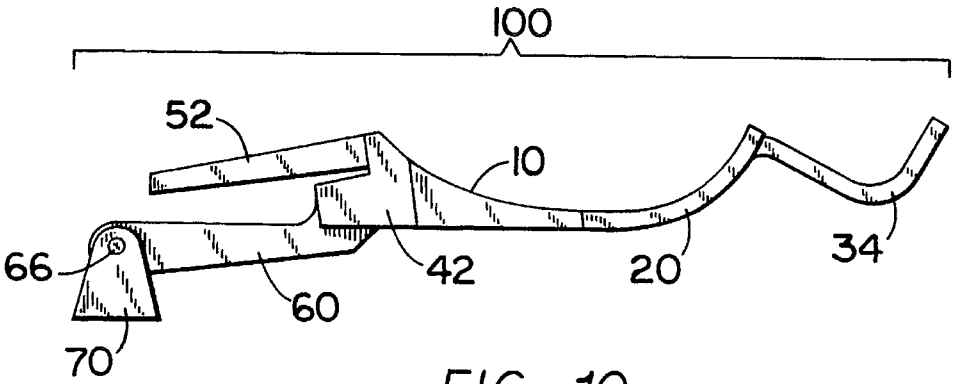
FIG. 10 Side view of the violin holder, with insertion clamp 70 disengaged.

Insertion clamp 70 is used to adapt violin holder 100 for use on music stand desks of varying thickness. (See FIGS. 4 and 6 for side views of insertion clamp 70.) For music stand desk shelves 220 which are thin, as is commonly the case in metal music stand desks, insertion clamp 70 is rotated to the upright position prior to attaching violin holder 100 to shelf 220. (See FIGS. 4 and 6) For music stand disk edge 220 which is relatively thick, as in the case in plastic injected molding music desks, the insertion clamp 70 is rotated to the downward position and is not utilized when attaching the violin holder 100 to the music stand desk shelf 220. (See FIG. 10.) Insertion clip 70 is placed into the upright position by coming into abutting contact with clamps 52 and 50. (See FIGS. 4, 5, 6 and 7.) Insertion clamp 70 is locked into the up, or engaged position by pushing it through the space between clamps 50 and 52, so that insertion clamp 70 is held in place by pressure exerted by clamps 50 and 52, thus allowing the user to easily attach the violin holder 100 to shelf 220 without adjusting insertion clip 70. This locked configuration of insertion clamp 70 is not shown in the drawings.

To use the violin holder 100, the user hangs violin 300 onto the violin holder 100 by placing the violin's or viola's scroll 310 into a space 36 and resting the violin scroll 310 onto curved support members 20 and section 32 of curve support member 30. (See FIG. 2.) The user then hangs the bow 400 onto section 34 of curved support member 30 by resting the frog 410 of bow 400 onto section 34 of curved member 30. (See FIG. 2.) The violin 300 thus hung from the violin holder 100 has its face 320 turned towards music stand desk support 230. The purpose of placing the violin 300 into the violin holder 100 in this way is to protect the face (not shown) and the bridge (not shown) of violin 300 from damage by people or equipment moving near the music stand to which violin 300 is attached.

Figure 7:
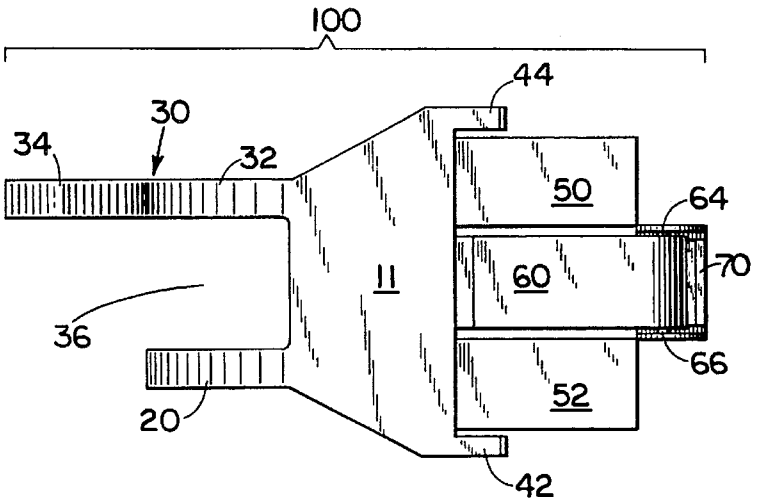
FIG. 7 Bottom view of the violin holder, with insertion clamp 70 engaged.
Figure 9:
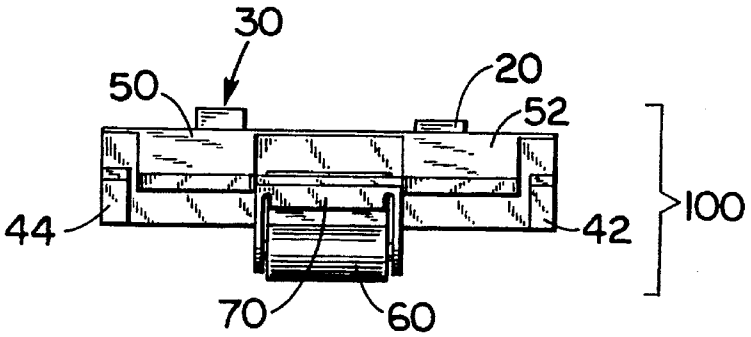
FIG. 9 Rear end view of the violin holder, with insertion clamp 70 engaged.
Figure 8:
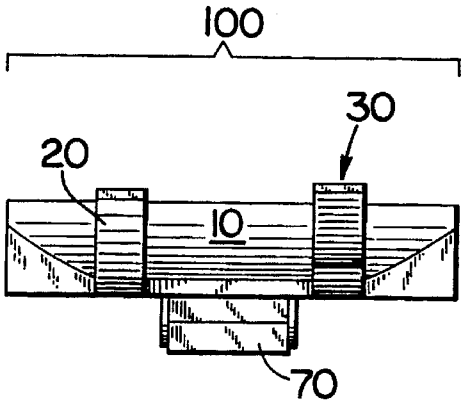
FIG. 8 Front end view of the violin holder, with insertion clamp 70 engaged.

FIG. 7 shows an underside view of violin holder 100, exposing surface 11, which is substantially flat. FIG. 7 shows insertion clamp 70 in the upright engaged position with insertion clamp 70 in direct abutting contact with top clamps 50 and 52. FIG. 8 is a front end view of violin holder 100, showing insertion clamp 70 in a down, or disengaged position. FIG. 9 shows a rear view of violin holder 100, showing insertion clamp 70 in the up, or engaged position. In FIG. 9, support member 30 is shown at a slightly higher elevation than support member 20. This is because support member 30 also includes additional support section 34 used for supporting the frog 410 of a bow 400. Because support member 30 is designed to support a slightly greater weight than relatively shorter support member 20, additional support section 34 extends from support section 32 (shown in FIGS. 5 and 7 at a slightly elevated angle relative to the angle of extension of support member 20 from surface 10.

Figure 11:
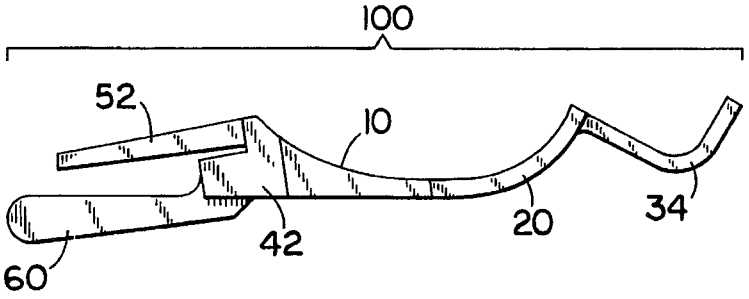
FIG. 11 Side view of the violin holder, without insertion clamp 70.

In an alternative embodiment of this invention, shown in FIG. 11, bottom clamp 60 of violin holder 100 does not have insertion clamp 70 attached to it, and does not have cylindrical projections 64 and 66 extending from clamp 60. This configuration of violin holder 100 is designed for use solely with music stand desks with a relatively thick music desk shelf 220 such as plastic injected molded music desks.

Figure 12A:
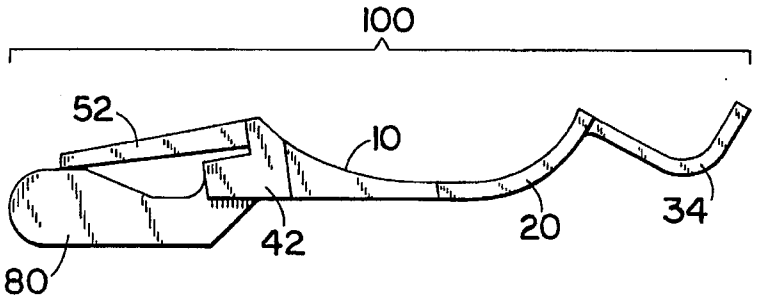
FIG. 12A Side view of the violin holder with alternative embodiment of clamp 60.
Figure 12B:
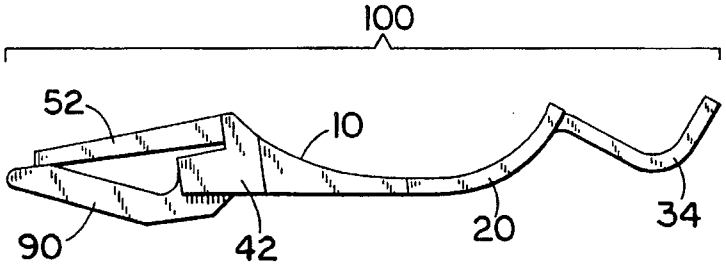
FIG. 12B Side view of the violin holder with second alternative embodiment of clamp 60.

In another alternative embodiment of violin holder 100, shown in FIG. 12A, clamp 80 is thickened in such a way that it abuts top clamps 52 and 50, thus duplicating the configuration of clamp 60 with insertion clamp 70 in the upright locked position. (See FIGS. 4 and 6.) In yet another alternative embodiment of violin holder 100, shown in FIG. 12B, clamp 90 is modified to angle upwards so that it comes into direct contact with clamps 50 and 52, again duplicating the configuration of clamp 60 with insertion clamp 70 in the upright locked position, shown in FIGS. 4 and 6. The embodiments of violin holder 100 shown in FIGS. 12A and 12B are designed for use with music stand desks whose shelves 220 are relatively thin, as is the case in metal music stand desks.

Figure 13:
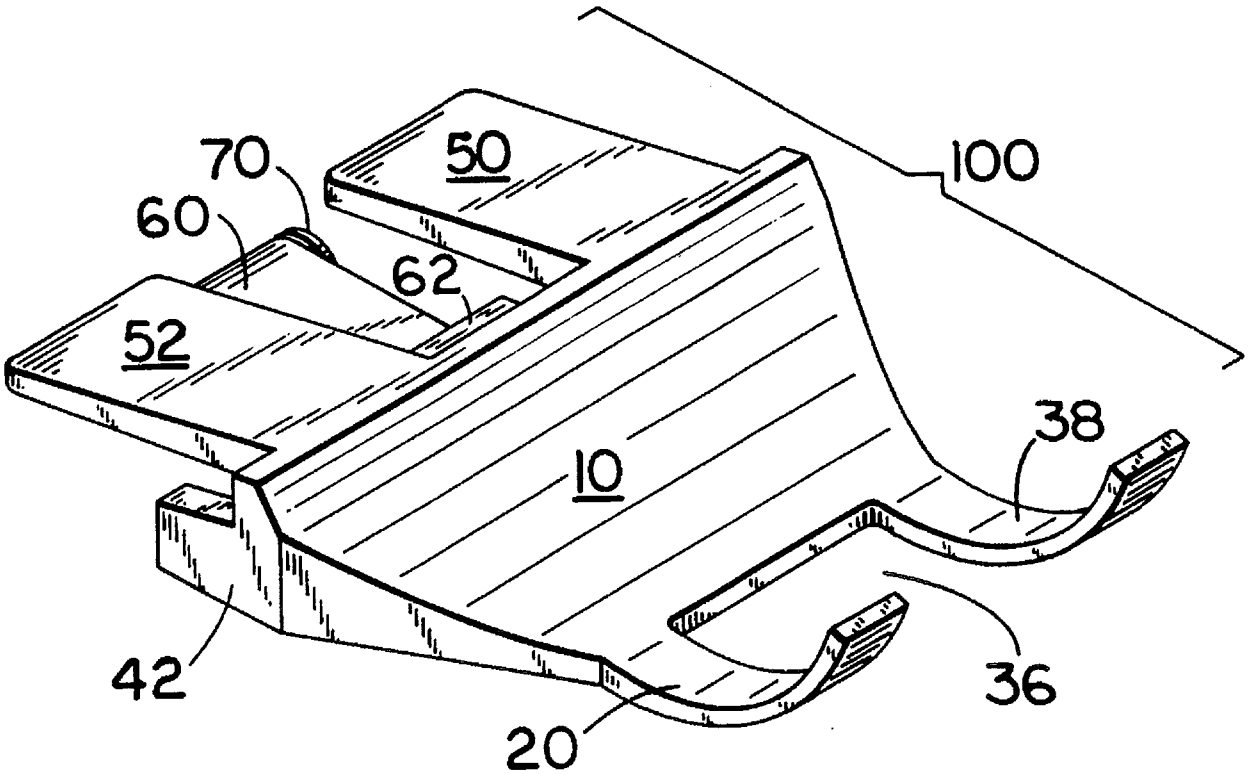
FIG. 13 A perspective view of alternative embodiment of the violin holder, without bow holder.

FIG. 13 shows an alternative embodiment of the violin holder 100, where extended support member 30 is replaced by support member 38, which is substantially identical in length and shape to support member 20. In FIG. 13, insertion clamp 70 is illustrated in the down or disengaged position. In this alternative embodiment, the violin .holder 100 functions solely as a string instrument holder, and does not provide a means for holding a bow. An additional alternative embodiment is contemplated, although it is not shown in the illustrations, and that is a configuration of the violin holder 100 which is designed solely for holding bows for string instruments. In this alternative embodiment, support members 20 and 38 in FIG. 13 would be replaced with support member sections in substantial conformity to the shape and length of support member 34 shown in FIGS. 1A, 3, 5, and 7 which is designed to support a bow 400 by the frog 410 of the bow.

Although the invention described in this specification has been referred to in many instances as the violin holder 100, it is not intended that use of this invention be limited to violins or violas. This invention, in varying sizes, is also contemplated for use in holding string instruments larger than violins and violas, such as cellas, guitars, mandolins, basses, and other string instruments. A successful prototype of the present invention was made from injection molded plastic and rubber. Other materials for manufacture of this invention, such as metal or wood, are also contemplated.

In compliance with the statutes, the invention has been described in language more or less specific as to structural features. While this invention is susceptible to embodiment in different forms, the drawings in the specification illustrate preferred embodiments of the invention, with the understanding that the present disclosure is to be considered an exemplification of the principles of the invention, and the disclosure is not intended to limit the invention to the particular embodiments described.

I claim:

1. A string instrument holder mountable on a support for holding a string instrument, the string instrument having a scroll, the string instrument holder comprising:

a first support member having a first concavity defined therein for supportingly receiving a first end of the scroll of the string instrument therein, the radius of curvature of the first concavity of the first support member is substantially upward with respect to gravity;

a second support member, longer than the first support member, the second support member having a first concavity defined therein for supportingly receiving a second end of the scroll of the string instrument therein, a second concavity formed between the first concavity and a distal end of the second support member for supportingly receiving a frog of a bow, the radius of curvature of the first concavity of the second support member is substantially upward with respect to gravity, the first support member and the second support member lie in a plane that is substantially horizontal with respect to gravity while the string instrument is supported by the support members;

a bottom clamp;

a top clamp resiliently mounted in opposed relation to the bottom clamp and spaced therefrom for mountingly receiving the support therebetween; and an insertion clamp pivotally mounted to a terminus of the bottom clamp for movement between an engaged position in which the insertion clamp is disposed between the bottom clamp and the top clamp and a disengaged position in which the insertion clamp is not between the bottom clamp and the top clamp.

2. A string instrument holder mountable on an edge of a shelf of a music stand desk for holding a string instrument, the string instrument having a scroll, the string instrument holder comprising:

a bottom clamp;

a first top clamp resiliently mounted in substantially opposed relation to the bottom clamp and spaced therefrom for engagingly receiving the edge of the shelf therebetween;

a second top clamp resiliently mounted to the bottom clamp, laterally spaced from and planar with the first top clamp;

a first arcuate support member extending substantially horizontally from the bottom clamp, having a radius of curvature substantially upward with respect to gravity, for supportingly receiving a first end of the scroll of the string instrument; and a second arcuate support member extending substantially horizontally from the bottom clamp, having a radius of curvature substantially upward with respect to gravity and spaced laterally from the first support member for supportingly receiving a second end of the scroll of the string instrument, the first support member and the second support member lie in a plane, the plane substantially horizontal with respect to gravity while the string instrument is supported by the support members.

3. The string instrument holder of claim 2 wherein the distance between the bottom clamp and the top clamps decreases as a terminus of the bottom and top clamps are approached, respectively.

4. The string instrument holder of claim 2 further comprising:

an insertion clamp pivotally mounted to a terminus of the bottom clamp for movement between an engaged position in which the insertion clamp is disposed between the bottom clamp and the top clamps and a disengaged position in which the insertion clamp is not between the bottom clamp and the top clamps.

5. A method of supporting a string instrument having a face and a scroll from a string instrument holder having a first support member and a second support member, each of the support members having at least a first concavity defined therein, the string instrument holder mounted on an edge of a music stand desk, the music stand desk mounted on a music stand vertical support member, the method comprising the steps of:

orienting the face of the string instrument toward the music stand vertical support member;

engaging a first and a second end of the scroll into the first concavity of the support members, respectively.

6. The method of claim 5 further comprising the step of:

engaging a frog of a bow into a second concavity of the first support member.

* * * * *